United States Patent [19]

Rudd

[11] Patent Number: 4,934,691

[45] Date of Patent: Jun. 19, 1990

[54] EXERCISE JUMP ROPE

[76] Inventor: Johnny Rudd, P.O. Box 116, Kaplan, La. 70548

[21] Appl. No.: 255,333

[22] Filed: Oct. 11, 1988

[51] Int. Cl.[5] ..... A63B 21/02

[52] U.S. Cl. ..... 272/75; 272/137; 272/141

[58] Field of Search ..... 272/74, 75, 141, 137

[56] References Cited

U.S. PATENT DOCUMENTS

| | | | |
|---|---|---|---|
| 3,972,238 | 8/1973 | Thatcher | 272/141 |
| 4,330,118 | 5/1982 | Race | 272/75 |
| 4,605,219 | 8/1986 | Mahana et al. | 272/75 |
| 4,729,560 | 3/1988 | Cho | 272/75 |
| 4,733,861 | 3/1988 | Plunkett | 272/75 |

*Primary Examiner*—Stephen R. Crow

*Attorney, Agent, or Firm*—Pravel, Gambrell, Hewitt, Kimball & Krieger

[57] ABSTRACT

A length of rope of the type utilized in a present jump rope, with an extended handle portion at each end of the length of rope. Each of the handle members would comprise a main cylinder having a bore throughout its length, with the length of rope threaded through the bore. Intermediate the rope body and the wall of the handle, there would be provided a resilient spring member extending substantially the length of the handle, and, with the end of the rope extending out of and secured to the distal end of the spring, with the proximal end of the spring secured within the handle, so that pulling the handles away from one another compresses the coil springs and establishes an exercise force of the user.

5 Claims, 2 Drawing Sheets

56

EXERCISE JUMP ROPE

BACKGROUND OF THE INVENTION

1. Field of the Invention

The apparatus of the present invention relates to exercise equipment. More particularly, the present invention relates to a jump rope of the type utilized by an individual, which would incorporate spring loaded handles for converting the jump rope to stretchable exercise equipment for use in various types of exercise routines.

2. General Background

In the ever increasing concern for good health through exercise, it is imperative that exercise equipment be available for the general public which is within the price range and affordability of most individuals, and is of a nature which would enable the user of the equipment to utilize the equipment in a restricted area, and to store it away or carry it rather conveniently. At present time, the type of equipment that has gained most popularity are the nautilus type machines, which enable an individual to undertake the various types of exercises in order to build up ones stamina for muscularity. However, the drawback to such equipment is the overall enormous expense which is required in order to obtain the full range of equipment with the various types of exercises, and, of course, the space requirement in order to house the equipment so that one may utilize the various types of equipment. In most cases, this would require a separate full size room, in the way of a small gym.

It has been found that one of the most efficient types of exercise equipment is the simple jump rope, of the type which is constructed of a length of rope which is connected onto handle portions, wherein an individual holds each handle portion and skips the rope as the rope circulates around the user. Of course, this type of exercise equipment is most commonly used, with boxers, which is used towards improving a person's coordination, leg, lung capacity, and stamina. At the present time, there are jump ropes on the market which are known to the present inventor, which have bearings in the handles in order to enable the rope to rotate with reduced friction, thus facilitating greater jumping ability.

There have been cited several patents which address jump ropes which have been improved, the most pertinent being as follows:

U.S. Pat. No. 4,593,899 issued to Robert Miller

U.S. Pat. No. 4,563,002 issued to George Jardine

Although these patents show alleged structural improvements in jump ropes, no combination of patents as cited, disclose the present invention, as will be recited hereinafter.

SUMMARY OF THE PRESENT INVENTION

The apparatus of the present invention relates to an improved jump rope which can be adaptable for use in various exercise routines for enabling various exercises to be undertaken other than the simple jumping of the rope. What is provided is a length of rope of the type utilized in the present jump rope, with an extended handle portion at each end of the length of rope. Each of the handle members would comprise a main cylinder having a bore throughout its length, with the length of rope threaded through the bore. Intermediate the rope body and the wall of the handle, there would be provided a resilient spring member extending substantially the length of the handle, and, with the end of the rope extending out of and secured to the distal end of the spring, with the proximal end of the spring secured within the handle against a shoulder portion. Therefore, as a pull is provided to the rope, the rope would be pulled out of the handle against the bias of the spring, and release of the rope, the spring would return to its extended uncoiled length within the handle. The spring would have the necessary compression so that as one maintained the length of rope in a stationary position, one could move the handles against the bias of the spring, and the necessary force to bias the spring in the compressed mode, would result in one exerting muscle power; therefore undertaking exercise. For example, one could stand on the center portion of the length of rope holding a handle in each arm and by raising each arm and fully extending the rope, the handles could be raised further against the bias of the spring thus creating a "pulling" exercise for each arm of the user while the rope is engaged under ones feet. There could be of course numerous other types of exercises, examples of which will be presented in the detail specifications.

Therefore, it is a principal object of the present invention to provide an exercise jump rope which can be adapted for use in various exercise routines in addition to jumping rope;

It is a further principal object of the present invention to provide an exercise jump rope wherein various exercises are undertaken by maintaining the rope in the stationary position, and exerting force against the spring loaded handles, where one exercises against the bias and compression of the spring members within the handle portions;

It is still a further object of the present invention to provide a jump rope, so that the rope, either in its fully extended mode, or in a shortened mode, can be utilized by the user to undertake a series of exercise routines without the use of other types of equipment;

It is still a further object of the present invention to provide a simple jump rope having spring loaded handles, which is easy to manufacture, easy to carry, may be utilized in a restricted area so that one can undertake a series of exercise routines at a minimum amount of cost and in a minimum amount of space.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
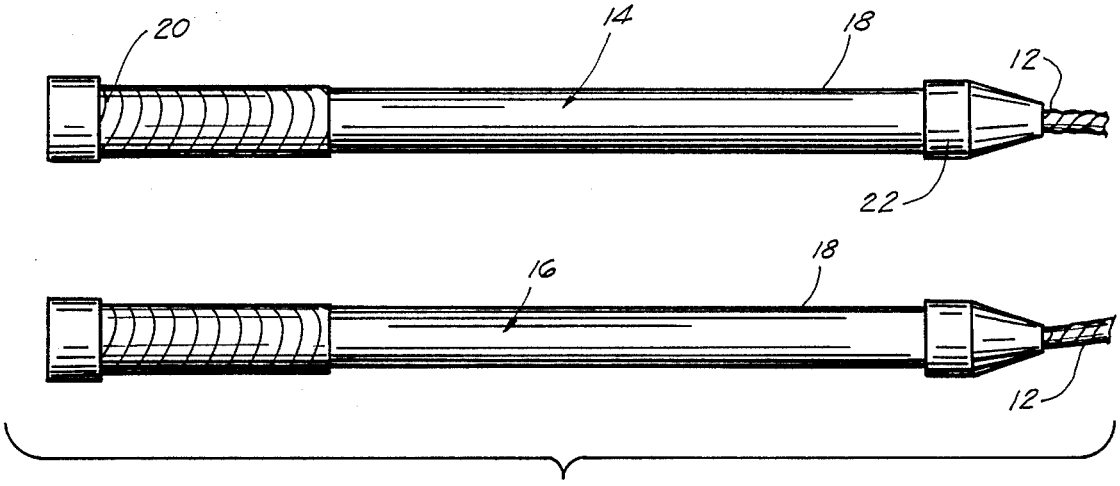
FIG. 1 is a an overall composite view of the handle portions of the exercise jump rope of the present invention.
Figure 2:
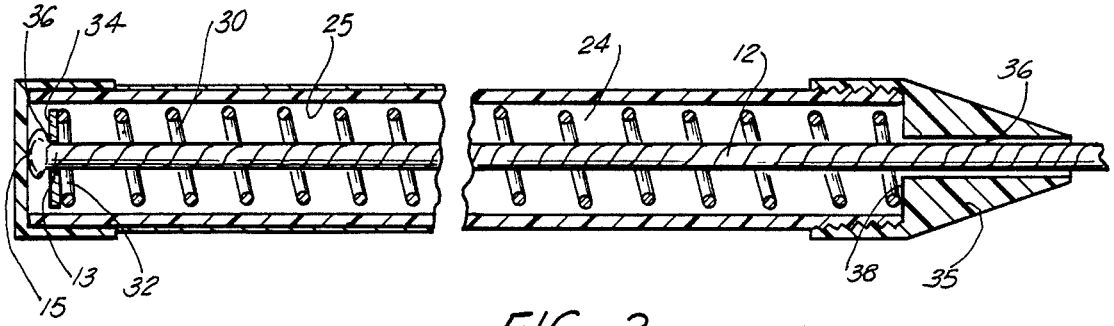
FIGS. 2 and 2A are isolated cross-section views of the handle portion of the preferred embodiment of the exercise jump rope of the present invention.
Figure 2A:
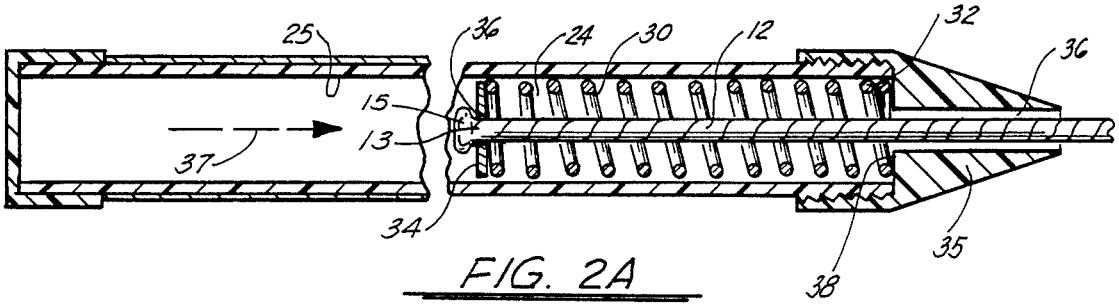

As illustrated in the FIGURES, the apparatus of the present invention is illustrated by the numeral 10. Exercise jump rope 10 would comprise a single length of rope 12, such as a strong nylon rope, of the type that would be generally utilized in a jump rope of the present state of the art. Length of rope 12 would be secured to handle portions 14 and 16 at both ends or rope 12 thereof. Each handle portion 14 and 16 would comprise a cylindrical body portion 18, having a first distal end 20 and a second proximal end 22, with body members 14, 16 having a continuous bore 24 therethrough, and defining a cylinder wall 25 within bore 24. For purposes of construction, bore 24 would be of substantially greater width than the width of rope 12. Rope 12 would be threaded through the bore 24 of handle 12, from its proximal end 22 to its distal end 20. As illustrated in FIGS. 2 and 2A, a compression spring member 30 is positioned within the bore 24 of handles 14, 16, and would extend substantially the length of handles 14, 16 with spring member 30 positioned intermediate the wall 25 of bore 24 and the length of jump rope 12 threaded through bore 24. Spring member 30 would be of the type of spring which would have a continuous coiled body 32, which can be compressed to a certain pounds per linear inch compression factor. In this particular embodiment, the preferable compression would be two and one half pounds per linear inch of compression.

As stated earlier, rope 12 is threaded through the coils 32 of compression spring 30, compression spring 30 is provided with a flat metal end portion 34 at its distal end, having a bore 36 therethrough, through which the end 13 of rope 12 is threaded. For purposes of construction, the end 13 of rope 12 would be modified through melting or the like and flared to form flared end 15, so as to provide a means for preventing the end to thread back through bore 36 in distal end portion 34 to secure rope 12 thereinto. Further, on the forward end of each handle 14, 16, there is provided a second lower end cap 35, which likewise includes a bore 36 therethrough through which the length of rope 12 is threaded. The cap 35 provides an internal shoulder portion 38 formed into the wall 37 of cap 35. Therefore, the lower end of spring 30 would be secured against shoulder 38, of cap 35, and maintained within bore 24 of handles 14, 16.

Therefore, as force is exerted by pulling the rope away from handle 12 or 14, in the direction of arrow 37 in FIG. 2A, the end 15 of rope 12 would likewise force the distal end of spring 30 to be forced downward within the bore of handle 14, thus creating a biasing of the spring against the pulling force, the result being that one is exerting effort as the rope is pulled away from the handles 14, 16. This principle of pulling the rope 12 against the bias of the spring 30 in each handle 14, 16 would result in the means by which the modified exercise rope can be used in various routines.

Figure 5:
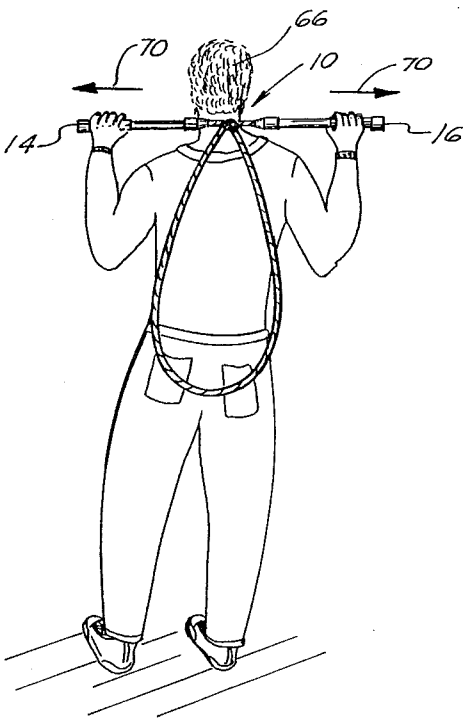
FIG. 3–5 are views of the exercise jump rope of the present invention being utilized in examples of exercise routines.
Figure 4:
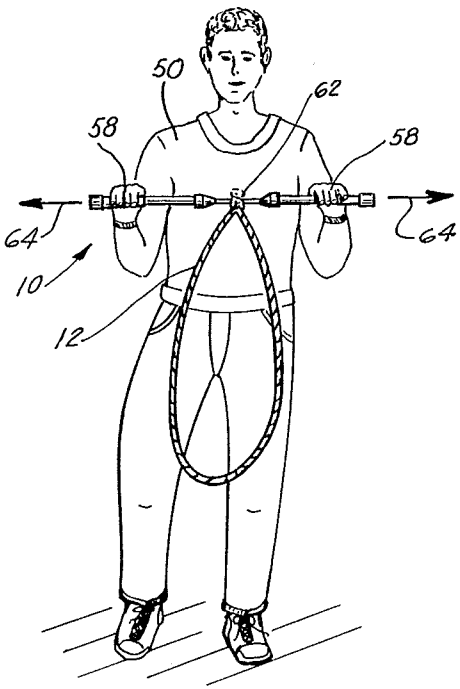
Figure 3:
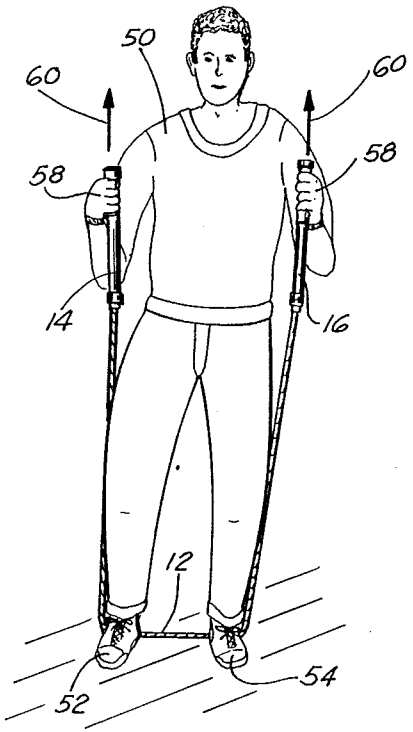

Reference is now made to FIGS. 3–5. In FIG. 3 there is illustrated a person 50, in standing position, with the person's feet 52 and 54 set upon the floor 56, the substantially central portion of the rope 12 secured beneath the feet 52 and 54 of the person 50 against the floor 56. As is further illustrated, each handle 14 and 16 is at least five inches in length and is held in each hand 58 of the person 50 and the person would then extend the rope to its full length in the direction of arrow 60, as illustrated in FIG. 3. Person 50 would pull up on handles 14, 16 the distance that coil spring 30 is able to be compressed, and in doing so would be, in effect, undertaking an exercise (in this case which would exercise the deltoid muscles), which could be of course done in a series of repetitions.

In FIG. 4, there is illustrated the same person 50, however, using the modified jump rope exercise apparatus 10 in a different manner. As is illustrated in FIG. 4, the user has secured each of the handle members 14 and 16 in his hands 58, with the handle members 14, 16 substantially positioned at shoulder width of the person. Since the length of the rope 12 in its usual mode would be greater than the distance by which one could extend one's hands, the user in this case has undertaken a simple method in order to shorten the length of rope so that the exercise can be undertaken. This method would simply include doubling the length of rope 12 over, and forming a single knot 62 in the middle of the rope as illustrated. Therefore the length of rope 12 would be shortened to the proper length as illustrated in FIG. 4, so that as the user exerts force outwardly on each handle 14, 16 in the direction of arrow 64, the rope 12 is maintained in the stable position, but the handle members 14, 16 are moved outward against the bias of springs 30 within each handle member. Therefore, one is undertaking an exercise which in this case would exert a person's pectoral and shoulder muscles for this particular exercise.

Likewise in FIG. 5, as a further example, the length of rope 12 has again been shortened in the same manner as is illustrated in FIG. 4, and the user has simply placed the length of rope 12 extended in its shortened mode behind one's head and is pulling outwardly in the direction of arrow 70, which would again undertake an exercise which would strengthen one's upper shoulder muscles, and arm muscles.

It should be made clear that the three exercises as illustrated in FIG. 3–5 are simply serving as examples of the many types of exercises that could be undertaken with this exercise jump rope apparatus, and is simply representative of the number of exercises available. It should be kept clear that the manner in which the rope is shortened as seen in FIGS. 4 and 5 simply illustrates an example of the length of which the rope could be shortened. The rope can be used in its fully extended length for certain exercises as is illustrated by example in FIG. 3. The governing criteria is at which point would the rope be of the necessary extended length for the beginning of the exercise so that one could pull the handles away from the rope and against the bias of the spring so that the spring is fully compressed to the end of the exercise therefore exerting the necessary exercise force of that particular routine.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An exercise jump rope, comprising:

(a) a length of rope;

(b) first and second handle members, each first and second handle member having a length of at least five inches and including a bore substantially through its length, for receiving the first and second end portions of the length of rope;

(c) a compression member having a first proximal end and a second distal end, each compression member having a compression value of at least two and one half pounds per linear inch. received within the bore extending substantially through the length of each of the first and second handle members; and (d) means for providing that the first and second ends of the rope threaded through the compression member within the bore of the handle members are secured to the distal end of compression member, so that pulling force on the rope by pulling the handle members away from one another results in a compression of the compression member within the handle members to a point substantially throughout the length of the bore within the handle member, and further defines a means for exerting exercise force during the pulling of the handle members.

2. The apparatus of claim 1, wherein the rope would be of sufficient length so that each handle member may be held at a person's side and the center of the rope would be resting on the floor.

3. The apparatus of claim 1, wherein each handle member would further comprise an annular shoulder around the inner wall of the bore at its forwardmost end, for maintaining the compression member wi thin the bore of the handle.

4. The apparatus of claim 1, wherein the compression member would further comprise a coiled spring.

5. An exercise jump rope apparatus comprising:

(a) a length of rope having first and second ends;

(b) a first handle member and a second handle member, each said first and second handle member having a length of at least five inches and further including a bore substantially through its length, for receiving the first and second ends of the rope therethrough;

(c) a coiled spring having a compression value of at least two and one half pounds per linear inch positioned within the length of the bore of each of the handle members, and including a bore formed by the coils of the springs, so that the length of rope may be threaded through the bore of the handle member and the bore of the coiled spring;

(d) means for securing the first and second ends of the rope through the distal ends of the coil springs in the handle members; and (f) means within the handle member for maintaining the coil spring within the handle member, as the rope is pulled away from the handle member against the bias of each of the coiled springs within the handle member, and the coil springs are retracted in length substantially through the entire bore of the handle member against the pull of the rope, and returned to their full length within the handle members when the rope is released.

* * * * *